US009651206B2

(12) United States Patent
Vasta et al.

(10) Patent No.: US 9,651,206 B2
(45) Date of Patent: May 16, 2017

(54) OPTIC FOR A LED CHIP AND RELATED LED LIGHTING DEVICE

(71) Applicants: Giuseppe Vasta, Novate Milanese (IT); Luca Meneghetti, Desio (IT)

(72) Inventors: Giuseppe Vasta, Novate Milanese (IT); Luca Meneghetti, Desio (IT)

(73) Assignee: KHATOD OPTOELECTRONICS SRL, Cinisello Balsamo (IT)

( * ) Notice: Subject to any disclaimer, the term of this patent is extended or adjusted under 35 U.S.C. 154(b) by 0 days.

(21) Appl. No.: 14/670,869

(22) Filed: Mar. 27, 2015

(65) Prior Publication Data

US 2015/0276147 A1 Oct. 1, 2015
US 2016/0153620 A9 Jun. 2, 2016

(30) Foreign Application Priority Data

Mar. 30, 2014 (IT) ..... MI2014A0550

(51) Int. Cl.

| | |
|---|---|
| ***F21V 31/00*** | (2006.01) |
| ***F21K 99/00*** | (2016.01) |
| ***F21V 7/00*** | (2006.01) |
| ***F21V 17/00*** | (2006.01) |
| ***F21V 29/70*** | (2015.01) |
| ***F21V 5/04*** | (2006.01) |
| ***F21V 5/08*** | (2006.01) |

(Continued)

(52) U.S. Cl.

CPC ..... *F21K 9/50* (2013.01); *F21K 9/60* (2016.08); *F21V 5/04* (2013.01); *F21V 5/08* (2013.01); *F21V 7/0025* (2013.01); *F21V 7/0066* (2013.01); *F21V 7/10* (2013.01); *F21V 17/002* (2013.01); *F21V 17/10* (2013.01); *F21V 29/70* (2015.01); *F21V 31/00* (2013.01); *F21V 31/005* (2013.01); *F21V 17/005* (2013.01); *F21V 25/12* (2013.01); *F21V 29/004* (2013.01); *F21W 2101/04* (2013.01); *F21W 2111/047* (2013.01); *F21W 2131/101* (2013.01); *F21W 2131/103* (2013.01); *F21Y 2101/00* (2013.01)

(58) Field of Classification Search

CPC ..... F21K 9/50; F21V 31/00; F21V 7/0025; F21V 7/10; F21V 17/002; F21Y 2101/02

See application file for complete search history.

(56) References Cited

U.S. PATENT DOCUMENTS

2015/0023021 A1* 1/2015 Hyun ..... F21V 3/02 362/293

* cited by examiner

*Primary Examiner* — Thomas M Sember
(74) *Attorney, Agent, or Firm* — Sughrue Mion, PLLC

(57) ABSTRACT

Optic for a LED chip, in particular of COB type, including a second element realized with an optical transparent material and having a first proximal end and a second distal end, a second external exit surface, a first total internal reflection external lateral surface which redirects and re-distributes a luminous flux realized by LED chip towards the second external exit surface, the second element including an internal blind cavity for housing LED chip. The optic includes a disc shaped first element extending externally with respect to said second element in an orthogonal direction to a longitudinal direction, and the first element and the second element are mutually integral through injection molding, and realized in one single piece through injection molding using optic grade transparent silicone elastomer for making a LED lighting device waterproof and anti-shock, avoiding the need of a gasket and external glass, and with reduced components.

15 Claims, 6 Drawing Sheets

(51) Int. Cl.

| | |
|---|---|
| ***F21V 17/10*** | (2006.01) |
| ***F21V 7/10*** | (2006.01) |
| ***F21K 9/60*** | (2016.01) |
| *F21V 25/12* | (2006.01) |
| *F21V 29/00* | (2015.01) |
| *F21W 101/04* | (2006.01) |
| *F21W 111/047* | (2006.01) |
| *F21W 131/101* | (2006.01) |
| *F21W 131/103* | (2006.01) |
| *F21Y 101/00* | (2016.01) |

OPTIC FOR A LED CHIP AND RELATED LED LIGHTING DEVICE

This invention relates to an optic for a LED chip and related LED lighting device for lighting large internal or external areas.

In particular this invention relates to an optic for a LED chip and related LED lighting device for road lighting and/or for applications in environments in the presence of humidity or water and also usable, in particular, for risk explosion applications.

Purpose of this invention is to produce an optic for a LED chip and related LED lighting device that allow a reduction of the cost of moulding and of the relative moulds and which allow at the same time to work at high operating temperatures without yellowing of said optic.

Another purpose is to provide an optical chip for a LED and related LED lighting device which are easy and simple to make.

A further purpose is to make an optic for a LED chip and related LED lighting device which are economically advantageous.

These purposes according to this invention are achieved by realizing an optic for a LED chip and related LED lighting device according to claims 1 and 14.

Further features of the invention are highlighted by the subsequent claims.

The features and advantages of an optic for a LED chip and related LED lighting device according to the present invention will become more clear from the following illustrative and non-limiting description, referred to the attached schematic drawings wherein.

Figure 1:
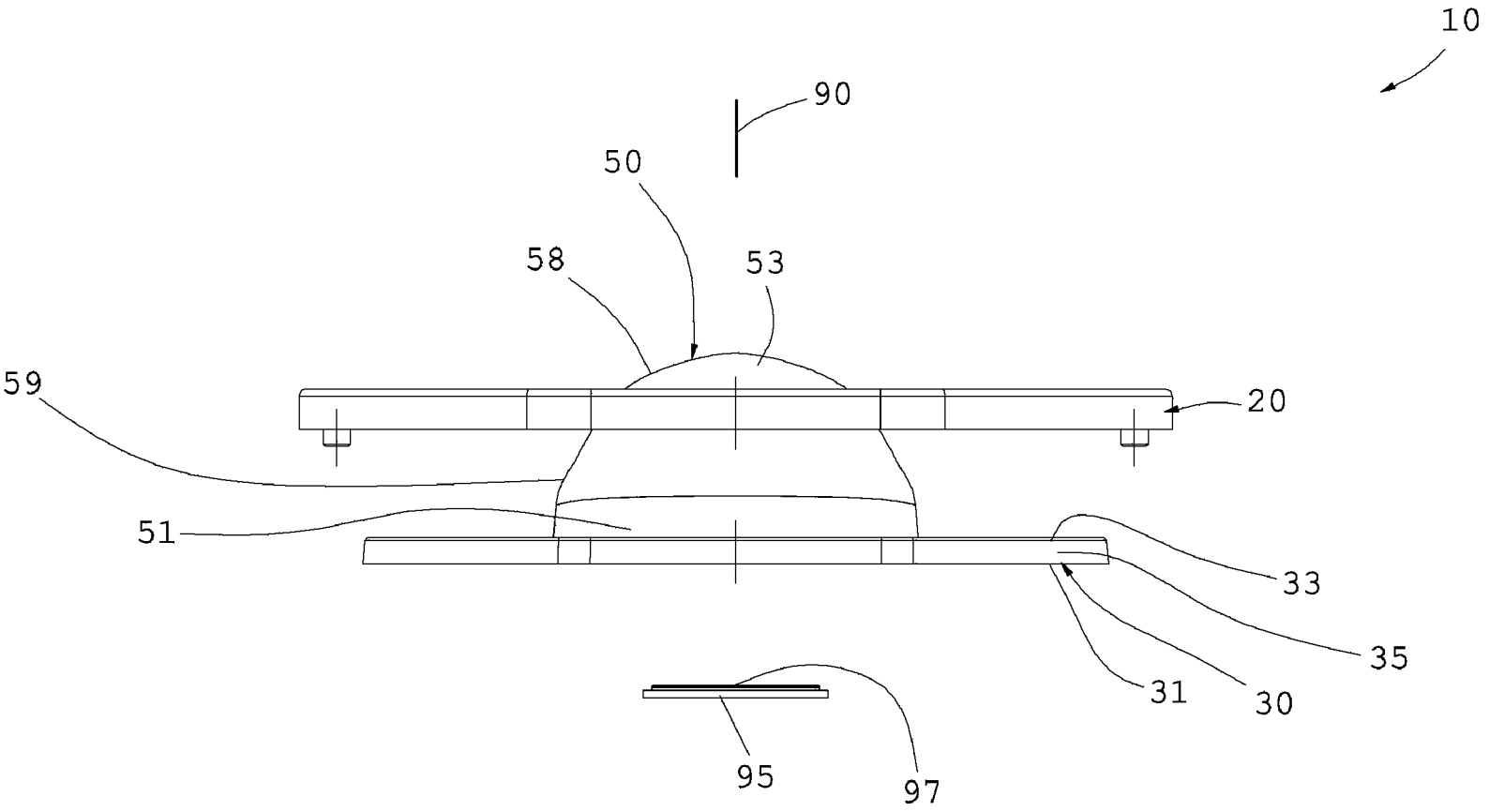
FIG. 1 is an exploded front elevation view of a preferred embodiment of an optic for a LED chip and of a LED lighting device according to the present invention.
Figure 2:
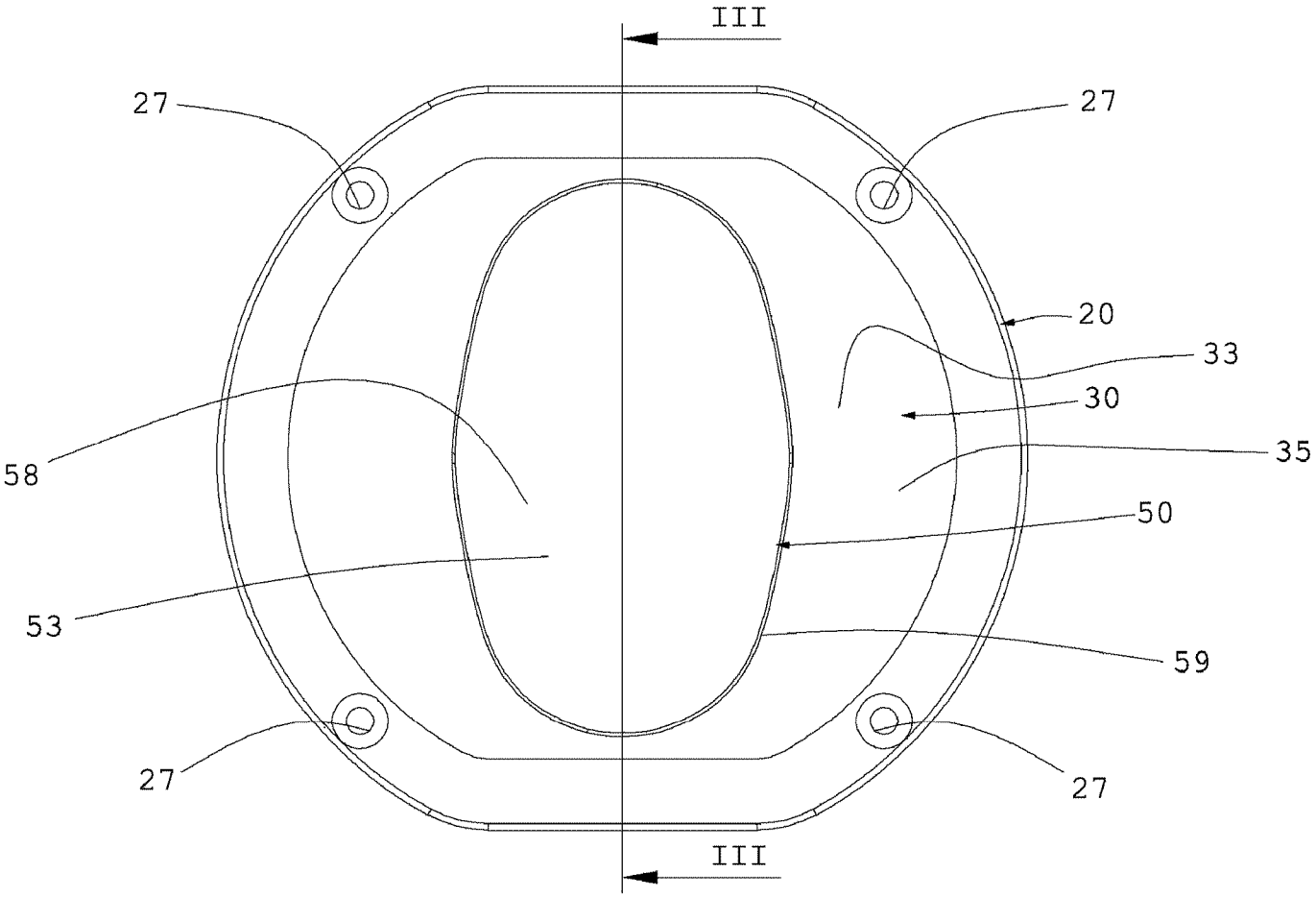
FIG. 2 is a top view of the optic and of the LED lighting device of FIG. 1.
Figure 3:
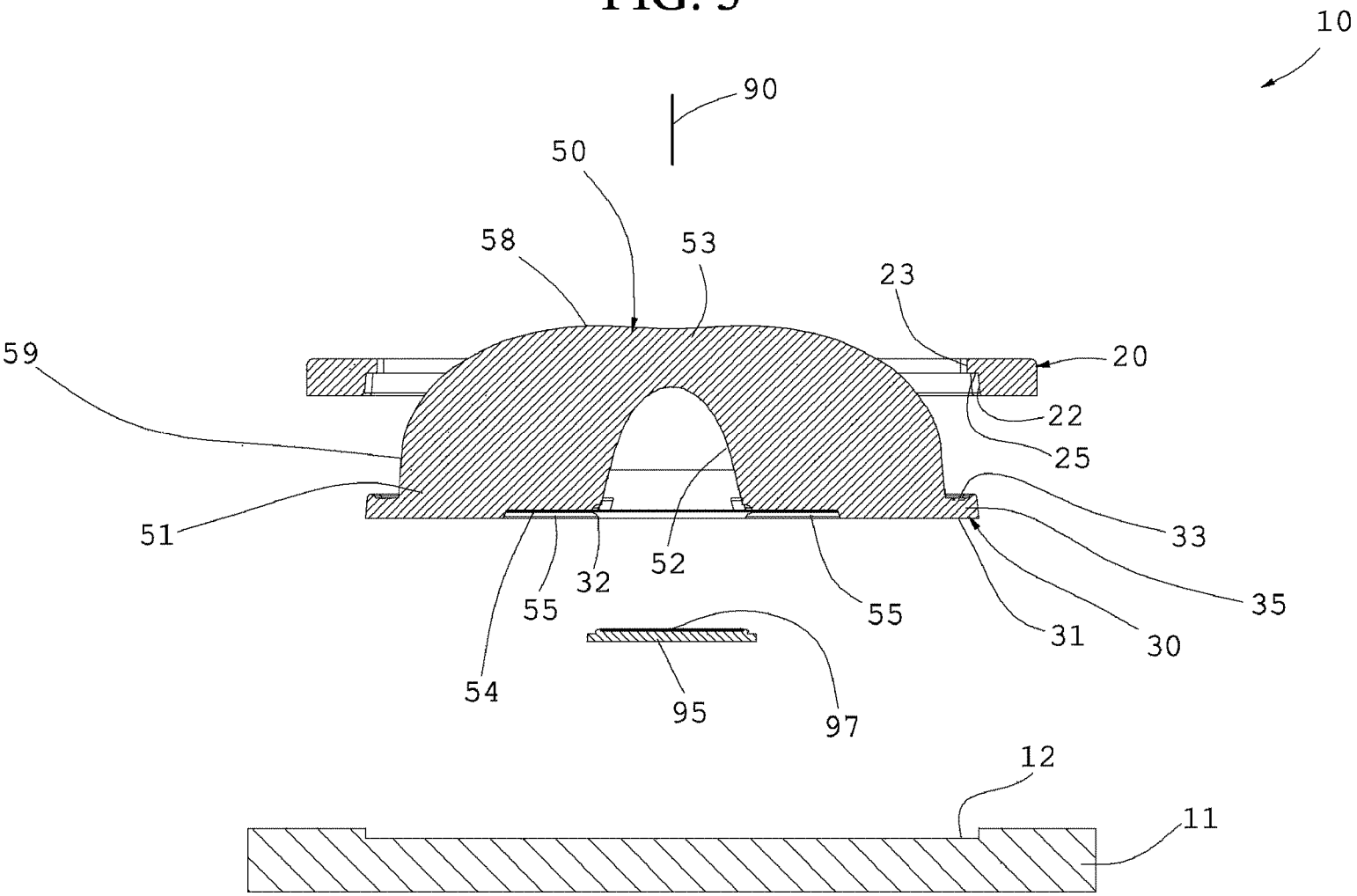
FIG. 3 is a front elevation sectioned view of the optic and of the lighting device of FIG. 2 sectioned along line III of FIG. 2.
Figure 4:
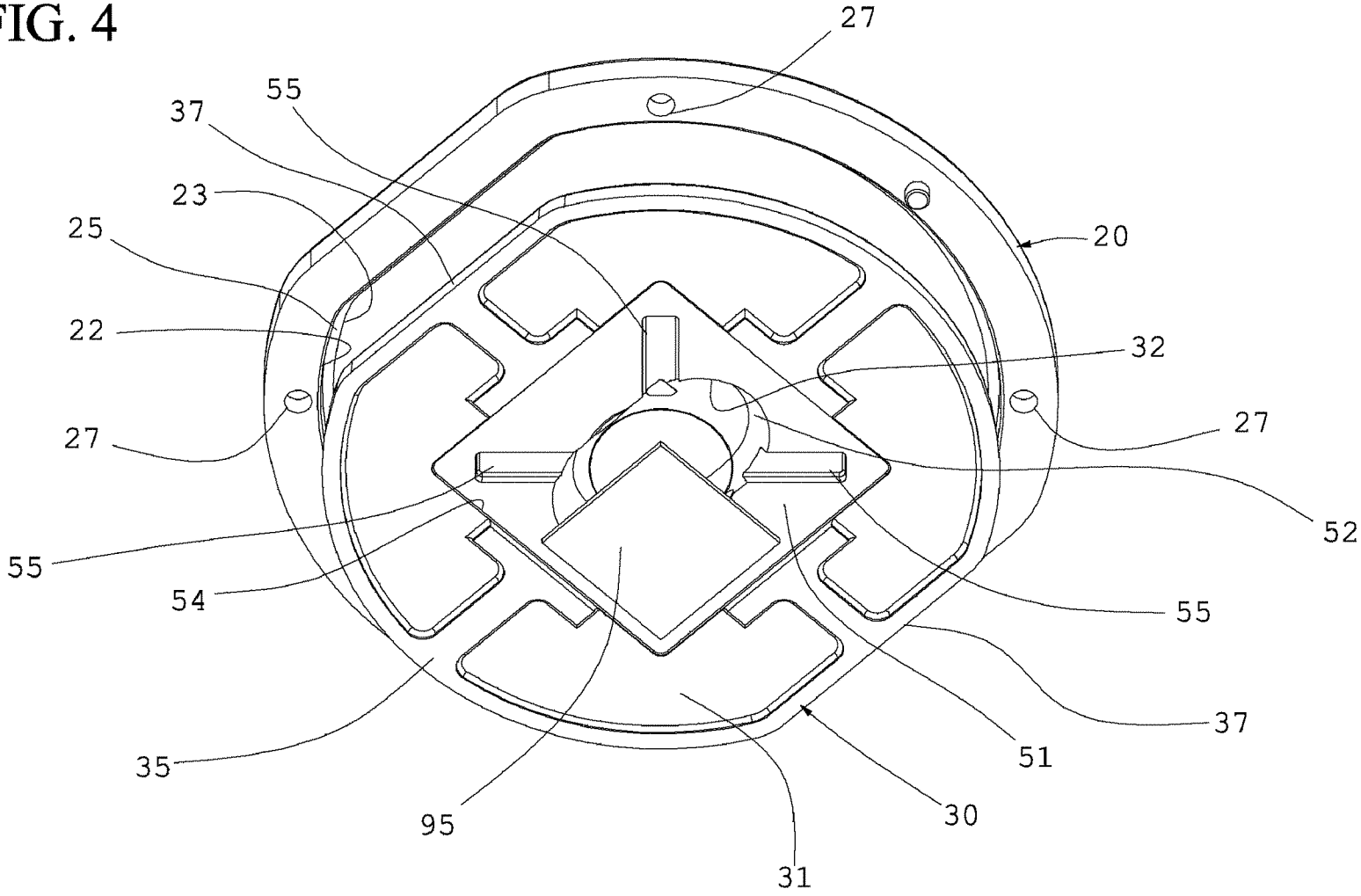
FIG. 4 is an exploded perspective view in right lateral elevation from the bottom of a detail of FIG. 1 according to this invention.
Figure 5:
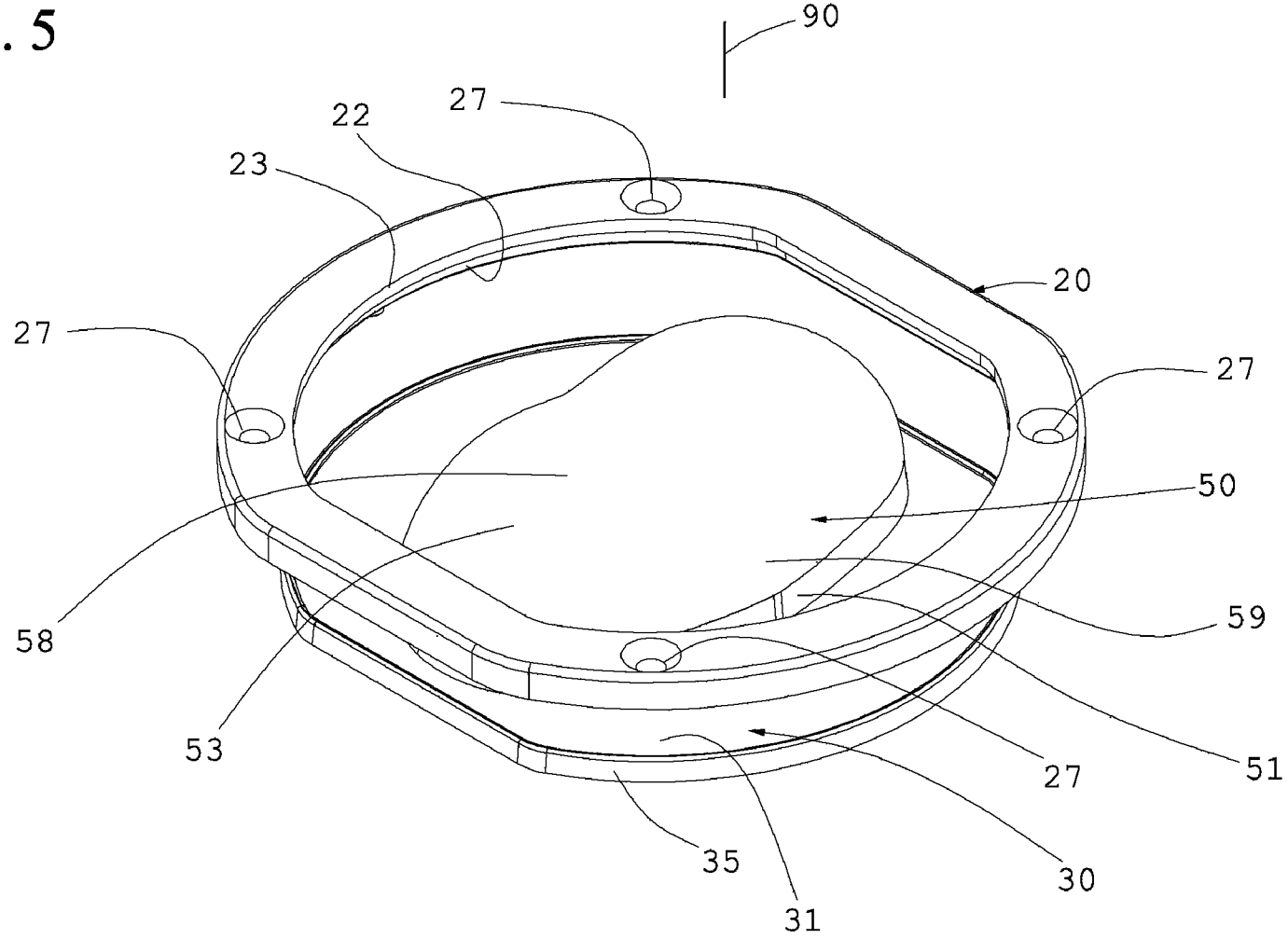
FIG. 5 is an exploded perspective view in right lateral elevation from the top of a detail of FIG. 2.
Figure 6:
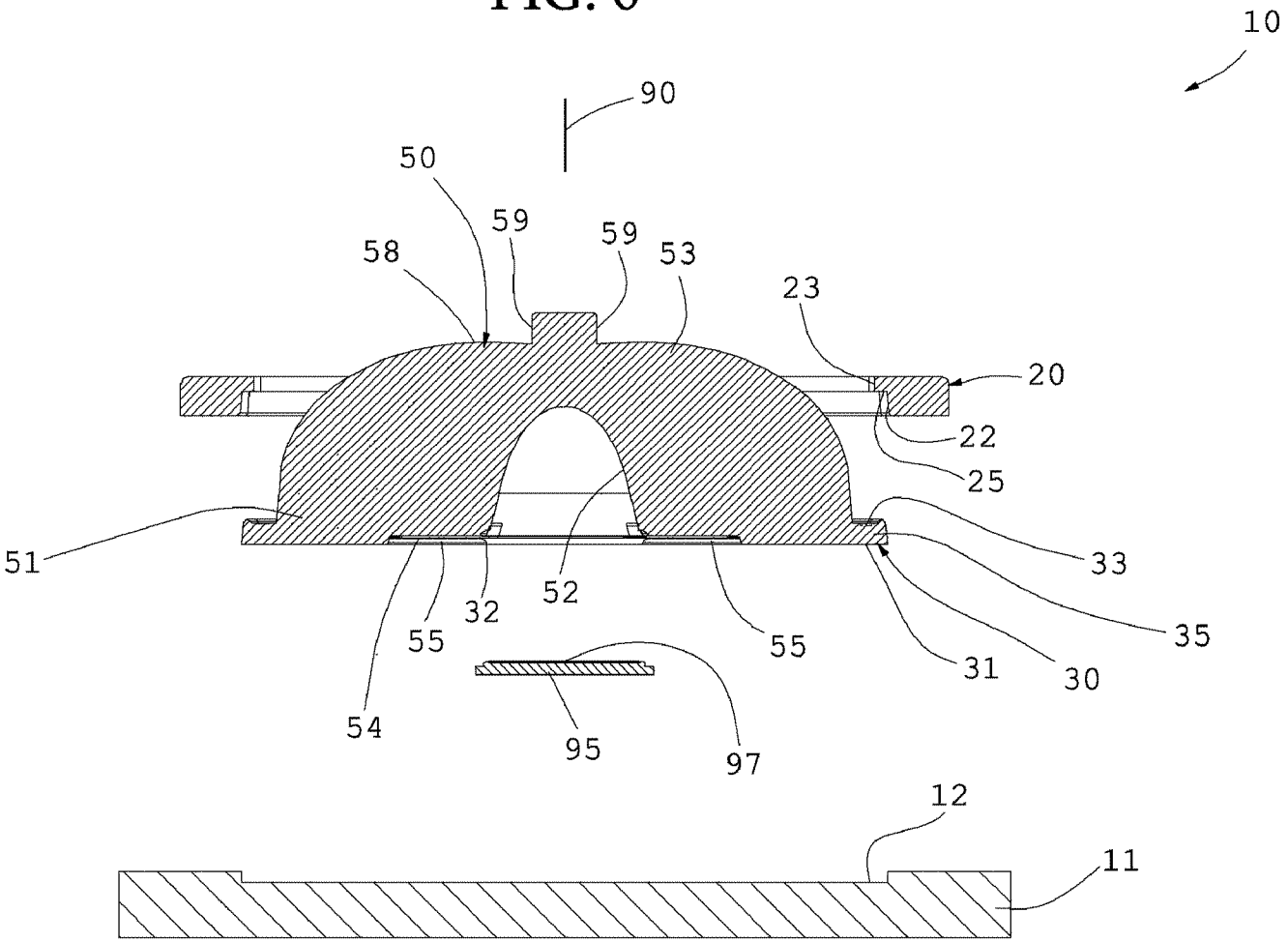
FIG. 6 is a front elevation sectioned view of a preferred embodiment of an optic and of a lighting device according the present invention.

With reference to the figures, is shown an optic for a LED chip 97 in particular of COB type, said optic comprises a second element 50 realized with an optical transparent material having a first proximal end 51 and a second distal end 53, a second exit external surface 58 positioned in proximity of said second distal end 53, a first total internal reflection external lateral surface 59 which is positioned between said first proximal end 51 and said second distal end 53 and which is able to redirect and re-distribute a luminous flux produced by said LED chip 97 towards said second external exit surface 58, said second element 50 also comprises a internal blind cavity 52 which is realized in proximity of said first proximal end 51, which extends substantially along a longitudinal direction 90 internally to said second element 50 towards said external exit surface 58 for housing of said LED chip 97 and also in particular of an electronic board 95 on which is mounted said LED chip 97.

According to this invention said optic comprises a first element 30 substantially disc shaped, in particular having a central hole 32, which extends externally with respect to said second element 50 in an orthogonal direction with respect to said longitudinal direction 90, and in addition said first element 30 and said second element 50 are realized mutually integral by injection moulding, in addition said first element 30, and in particular at least one external peripheral portion 35 thereof is compressible independently with respect to said second element 50, and in particular without determining an indirect deformation thereof, for making waterproof said LED chip 97 and in particular also an electronic board 95 by avoiding at the same time an undesirable modification of the optical properties of said second element 50 and by avoiding, at the same time, the need of a gasket.

In particular said first element 30, and in particular at least a outer peripheral portion 35 of which the latter is equipped, is connectable by fastening means so as to be compressed within a housing of a LED lighting device 10 so as to create a high impermeability to said LED chip 97, and in particular also to said electronic board 95, avoiding the need of an additional gasket and avoiding an undesirable modification of the optical properties of said second element 50.

In this way, it is advantageously obtained an easy fastening and a high impermeability by avoiding at the same time a deformation of said second element 50 having an optical function, without thus affecting even indirectly the optical properties of said second element 50 and therefore also of said optic, by reducing to a minimum the number of components and by simplifying the manufacture of a LED lighting device 10.

In particular, in other terms, said second element 50 is able to surround and completely wrap said LED chip 97 and an upper surface of said electronic board 95, said first element 30, and in particular a outer peripheral portion 35 thereof, being constrainable to a housing 12 of a LED lighting device 10, through fastening means so as to create a high impermeability and water resistance by reducing advantageously to a minimum the number of components and by avoiding advantageously the need for a protection external glass.

In particular said first element 30 and said second element 50 are realized in just one single piece through injection moulding, in particular with an optic grade transparent silicone elastomer, for producing a waterproof LED lighting device 10 and having a high degree of water protection, by reducing to a minimum the number of components, further preferably said first element 30 is mechanically elastic and flexible with respect to said second element 50 for allowing a perfect compensation of the plays and the mechanical tolerances, and therefore a better sealing and impermeability against water over time.

Advantageously, this allows to reduce to a minimum the number of components and to produce a plurality of LED lighting devices 10 in particular for explosion risk environments by avoiding the need of brittle materials such as, for example, an external glass or other external element which is external to said optic and which is usually realized with very rigid polymers which by breaking could injure people or damage property.

Besides the number of moulds and also the costs for the moulds are reduced advantageously since through injection of a liquid optic grade transparent silicone elastomer, which has a low viscosity, the costs and time of moulding are reduced significantly, and, in addition, the force of the press to be coupled to the injection plant thus allowing advantageously to be able to mould large size optics with a low strength of the press, which would be unthinkable with traditional polymers.

Advantageously, this also allows avoiding the use of an external glass since it is possible to mould said second element 50 with a high thickness and a high size with the same material of said first element 30 and with high shock-proof characteristics.

Furthermore, with respect to traditional technopolymers, said optic realized preferably in one single piece is shock-proof and anti-vibration since it is preferably elastomeric, and in addition over time it does not show formation of micro-cracks hence without losing therefore the impermeability characteristics.

In addition, preferably said optic grade transparent silicone elastomer allows use at very high operating temperatures, in particular above 150° C. and in particular above 170° C. by allowing the use of high power LED chips 97 and by maintaining over time a high transparency without yellowing by allowing advantageously to maintain high optical efficiencies despite the high operating temperatures.

Moreover, despite the high cost of said optic grade transparent silicone elastomer, the total cost for each optic is reduced since the cost of the moulds is reduced because there is no need for high power presses since it is advantageously injected liquid and subsequently vulcanised or cross-linked.

Furthermore, preferably said first element 30 extends externally with respect to said first proximal end 51 or with respect to said second distal end 53 of said second element 50 in an orthogonal direction with respect to said longitudinal direction 90, and in particular said first element 30 extends externally with respect to said first proximal end 51 in an orthogonal direction to said longitudinal direction 90.

Preferably said first element 30 and said second element 50 are realized with a transparent optic grade silicone elastomer through injection moulding and subsequent curing or cross-linking.

Advantageously, this allows injecting within a single mould a optic grade transparent silicone elastomer in a liquid form by reducing to the minimum the cost of equipment and of the press since the latter has low viscosity- and a high fluidity.

Preferably in the case wherein said first element 30 and said second element 50 are made in just one single piece with a optic grade transparent silicone elastomer through injection moulding in liquid form, and subsequent curing or cross-linking, said first total internal reflection external lateral surface 59 is not essential, and therefore, in this case, it will be only preferred, and consequently in this case said optic preferably comprises a first total internal reflection surface 59 in particular which is external and more in particular lateral.

In particular said optic grade transparent silicone elastomer is selected from a methyl silicone, a vinyl-methyl silicone, a phenyl-vinyl methyl silicone and a fluorine-vinyl-methyl silicone and/or their blends and/or their derivatives.

In particular said optic grade transparent silicone elastomer is a bi-component silicone for injecting the same in liquid form in a mould, by obtaining reduced costs of the injection and moulding, by maintaining at the same time unaltered the properties of each of the two components over time by avoiding a degradation of the properties thereof during the storage period.

In addition, preferably said optic grade transparent silicone elastomer has a hardness less than 100 shore and in particular less than 82 shore and even more in particular between 40 and 100 shore, and preferably between 40 and 90 shore, for preventing micro-cracks or fragile breakages of said optic and for allowing at the same time to make with just one piece a waterproof and water resistant optic which is capable of giving to a LED lighting device 10 a corresponding high impermeability and water resistance, and therefore, in particular a high degree of IP protection, in particular, by means of a simple coupling through fastening means capable of fastening the optic thereof to a housing of a LED lighting device 10.

In particular said optic is a secondary optic which is external to said LED chip 97 and which surrounds completely said LED chip 97 and also a relative electronic board 95 on which is preferably mounted said LED chip 97 to protect and waterproof the latter, by avoiding the need of a gasket and of an external glass such as, for example, in the case of optics and road lighting devices.

Preferably said first element 30 is a substantially planar disc 30 and in particular having an average thickness reduced for allowing a high elasticity and flexibility to compensate the plays with the fastening means and to maintain a high impermeability to water of said LED lighting device 10.

Furthermore, preferably said first element 30 comprises, in particular a central hole 32 for surrounding said LED chip 97 for making a lighting device 10 waterproof and water resistant, in particular said central hole 32 is integrated with a portion of said internal blind cavity 52 positioned in correspondence of said first proximal end 51 of said second element 50 and having the function of housing of said LED chip 97 and said electronic board 95 and preferably for a plurality of electrical contacts.

Preferably said second element 50 comprises a rectangular groove 54 realized in correspondence of said first proximal end 51 in proximity of said internal blind cavity 52 for housing an electronic hoard 95 on which is preferably mounted said LED chip 97, and in addition said second element 50 comprises a plurality of linear grooves 55 realized in correspondence of said first proximal end 51 in proximity of said internal blind cavity 52 for housing a plurality of electrical contacts, which are integrated with said rectangular groove 54 and with said internal blind cavity 52 for having a high impermeability of said electronic board 95 and of said LED chip 97 with respect to water and with respect to atmospheric agents, by reducing at the same time the overall dimensions and the number of components.

Furthermore, in particular said second element 50 also comprises four linear grooves 55 arranged substantially crosswise in correspondence of said first proximal end 51 in proximity of said internal blind cavity 52 for housing a plurality of electrical contacts.

Preferably said second element 50 is axially symmetrical with respect to said longitudinal axis 90, and, in particular also said first total internal reflection external lateral surface 59 is axially symmetrical with respect to said longitudinal axis 90.

Preferably said second element 50 has a substantially semi-ovoid form or of the "free-form" type for making very different optics.

Preferably said second element 50 is an asymmetric optic, in particular with respect to said longitudinal axis 90, which is capable of generating at least an asymmetric luminous distribution with respect to said longitudinal axis 90 and besides which it determines an inclination of the luminous flux in an inclined direction with respect to said longitudinal axis 90 of said LED chip 97 by an angle between 35° and 55°. and, in particular included between 40° and 50°, so as to avoid tilting said latter asymmetric optic and/or said LED chip 97.

In this way, it is advantageously possible to easily mount said optic quickly in a planar housing 12, in particular through automatic robotic means for the assembly.

Preferably said second asymmetric element 50 is capable of generating an asymmetric luminous distribution along two mutually orthogonal directions, each of which is orthogonal to the said longitudinal axis 90 of said LED chip 97.

In particular said second asymmetric element 50 generates a first asymmetric luminous distribution with respect to a first axis, which is orthogonal to a longitudinal axis 90 of said LED chip 97, and also generates a second asymmetric luminous distribution with respect to a second orthogonal axis to both the said longitudinal axis 90 and the said first axis.

Preferably said first asymmetric luminous distribution shows a peak of luminous intensity which is inclined with respect to said longitudinal axis 90 of said LED chip 97 by an angle between 35° and 55° and, in particular, between 40° and 50°, said first luminous distribution being asymmetric for distributing the light evenly and uniformly along a portion of a transverse surface to a direction along which are arranged a series of LED lighting devices 10.

Preferably said second asymmetric luminous distribution shows a peak of luminous intensity which is inclined with respect to said longitudinal axis 90 of said LED chip 97 by an angle between 35° and 55° and, in particular, between 40° and 50°, said second luminous distribution being asymmetric for distributing the light evenly and uniformly along a surface portion wider along a path, even curved, on which are arranged a series of LED lighting devices 10.

Preferably said second element 50 comprises at least two half toroidal or ovoid portions, in particular, substantially mutually orthogonal or aligned, which are mutually interpenetrated in one single piece together with said first element 30 for making very different optical geometries, in particular symmetrical with respect to one direction and asymmetrical with respect to another orthogonal.

Preferably each half toroidal or ovoid portion has a symmetry axis, and besides said two half toroidal or ovoid portions being mutually interpenetrated so that the corresponding symmetry axes thereof are substantially mutually orthogonal or parallel, in particular each half toroidal portion is realized with a liquid silicone elastomer of the previously described type.

Advantageously, this allows reducing the cost of said optic and allows having a luminous flux inclined with respect to a longitudinal axis 90 of said LED chip 97, without having to mount said inclined optic with respect to said LED chip 97.

Preferably said optic comprises a plurality of second elements 50 which are realized in just one single piece with said first element 30 through injection moulding of said optic grade transparent silicone elastomer preferably bi-component, each second element 50 allows housing of a corresponding LED chip 97 for making a waterproof and shockproof LED lighting device 10 having a reduced number of components and having a high luminosity, stable over time.

Preferably each second element 50 of said plurality of second elements 50 is an asymmetric optic with respect to a longitudinal axis 90 of a corresponding LED chip 97, also in particular at least a second asymmetrical element 50 is at the same time rotated with respect to a third axis, which is parallel to said longitudinal axis 90, of a first predetermined angle which is measured with respect to an orthogonal axis to said third axis, also at least another second asymmetrical element 50 is at the same time rotated with respect to a third axis, which is parallel to said longitudinal axis 90, of a second predetermined angle measured with respect to an axis which is orthogonal to said third axis.

Advantageously, this allows making also LED lighting devices for illuminating large internal or external surfaces or for road lighting by allowing to make simply very different luminous fluxes.

Preferably said first element 30 comprises at least one reference portion 37 realized on an external perimeter and in particular at least two reference portions 37 realized on an external peripheral portion 35 of said first element 30 for facilitating the positioning and for reducing the overall dimensions in case of coupling of two LED chips 97 with corresponding optics In particular said first element 30 does not have through holes for screws or other fastener elements so as to maintain a high stable impermeability over time and for avoiding the formation of cuts or cracks over time.

Preferably said second element 50 comprises at least one open through conduit which has two correspondent ends realized on the external surface of said optic, in particular on said first total internal reflection external lateral surface 59 and/or on said second exit external surface 58, for increasing the cooling with air or water, maintaining at the same time a high impermeability of said optic.

According to another aspect of this invention, an optical assembly is provided comprising at least an optic according to the embodiments and the variants previously described and also comprising at least a fastener crown 20 comprising a central through hole 23 which allows the insertion of said second element 50 through the same, and also comprising a housing 22 for said first element 30 for compressing the latter within a housing 12 of a lighting device 10 for making it waterproof and advantageously without having to fix said LED chip 97 to said housing 12 and by avoiding advantageously the need of a gasket or of an additional external glass.

Preferably said annular housing 22 is in particular coaxial with said central through hole 23 and oriented along said longitudinal direction 90, and also said annular housing 22 includes an annular base surface 25 for exerting a compression on said first element 30 for making waterproof said LED chip 97 and said LED lighting device 10.

Preferably said fastener crown 20 comprises a plurality of fastening holes 27 which are more external with respect to said first element 30 of said optic for not perforating the same and in particular said fastener crown 20 comprises at least a reference portion for easily positioning and coupling the same with a housing 12 of a LED lighting device 10.

In particular said fastener crown 20 includes a corresponding central through hole 23 an annular portion having a transversal section substantially "L"-shaped for allowing a simple compression of said first element 30 within a corresponding housing 12 of a LED lighting device 10 for making the latter waterproof without the need of a gasket.

According to another aspect of this invention, an optical assembly is provided comprising a plurality of optics according to the embodiments and variants previously described, and wherein said first element 30 is identical for each optic of said plurality of optics and wherein each second element 50 comprises a different first total internal reflection external lateral surface 59 and/or a different internal blind cavity 52 and/or a different second external exit surface 58 for making a LED lighting device 10 having a plurality of waterproof and interchangeable optics for illuminating large areas and/or road lighting and/or for underwater applications by reducing to a minimum the number of components and by avoiding advantageously the need of a gasket or of an additional glass.

Advantageously, this allows a user to realize an optical assembly wherein each optic is interchangeable by allowing a user to easily modify the luminous distribution without having to replace the entire LED lighting device 10.

According to another aspect of this invention a LED lighting device 10 is provided comprising an optical assembly according to any one of the embodiments and variants previously described and comprising at least one LED chip 97, in particular mounted on an electronic board 95, further said LED lighting device 10 comprises a housing 12 for said at least one optic, in particular for said first element 30 of said optic, in which is housed in turn said at least one LED chip 97.

Preferably said first element 30 comprises an upper base surface 33 and a lower base surface 31 which is insertable within said housing 12 so as to surround and wrap upwardly said LED chip 97 and said electronic board 95, said upper base surface 33 of said first element 30 at least in proximity of said external peripheral portion 35 is coupled with a housing 22 of said fastener crown 20 which is fixable to a body 11 of said LED lighting device 10 in proximity of said housing 12 for compressing said first element 30 within said housing 12 for making waterproof said LED lighting device 10 in a simple and effective manner without the need of a gasket or of an additional external glass.

Advantageously, in fact, said first element 30 extends externally to said second element 50, and also said fastener crown 20 determines only a compression of said first element 30 and in particular of at least an outer peripheral portion 35 thereof, by allowing an easy fastening and a high impermeability of said LED lighting device 10 by avoiding at the same time a deformation of said second element 50 having an optical and shockproof function, advantageously without therefore affecting also indirectly the optical properties of said second element 50 and thus also of said optic.

Preferably said at least one fastener crown 20 includes a central through hole 23 which allows the insertion of said second element 50 through the same, and further comprises a housing 22 for said first element 30 for compressing the latter within a housing 12 of a lighting device 10 to make the latter waterproof and advantageously without having to fasten said LED chip 97 to said housing 12 and by avoiding advantageously the need of a gasket or of an additional external glass.

Preferably said annular housing 22 is in particular coaxial with said central through hole 23 and oriented according to said longitudinal direction 90, and further said annular housing 22 includes an annular base surface 25 for exerting a compression on said first element 30 for making waterproof said LED chip 97 and said LED lighting device 10.

Preferably said body 111 is integrated with a heat sink and is realized with a material having a good thermal conductivity such as for example a metal for obtaining a very compact LED lighting device 10 and with an extremely reduced number of components.

Preferably said LED chip 97 comprises a LES emission surface of said luminous flux having a radius or a side included between 1 and 3 cm and in particular said LED chip 97 has a power higher than 5 watts in particular higher than 20 watts and preferably higher than 50 watts.

Advantageously in this way it is possible to use at least a LED chip 97 having high operating temperatures which can be coupled advantageously to a corresponding optic for advantageously making a LED lighting device 10 impermeable to water for illuminating large surfaces and/or for road illumination and/or for maritime applications and/or aeronautic applications and/or for explosive environment applications and/or for underwater applications such as floating buoy marker, and/or anti-shock and waterproof lighting fixtures with a perfect sealing over time and with a reduced number of components and reduced maintenance and a long life.

Preferably said lighting device 110 is an anti-shock and waterproof lighting device which comprises a supply battery preferably rechargeable for realizing a wireless transportable lighting device, and also in particular said lighting device 10 comprises an internal air chamber for floating of the same in the water, in particular for lighting underwater or maritime applications.

Preferably said lighting device 10 is an anti-shock and waterproof road lighting device, such as for example a road lamp post or for large areas, both for indoor and outdoor, or a lighting device for land vehicles or for aeronautical applications or for oil platforms or for illumination of tunnels or mines, or for lighting underwater or maritime applications and in particular in the naval industry.

Advantageously, the optic the optical assembly and the LED lighting device 10 avoid the need of a gasket or of an external protection glass and ensure impermeability and high operating temperatures accompanied by excellent optical efficiencies by allowing the use in many applications and sectors thanks also to the anti-shock and explosion-proof properties given by said elastomeric optic realized in only one piece with a optic grade silicone elastomer.

It has thus been seen that an optic for a LED chip and a related LED lighting device according to the present invention achieve the purposes highlighted previously.

The optics for a LED chip and the related LED lighting device of the present invention thus conceived are susceptible to numerous modifications and variations, all falling within the same inventive concept.

Moreover, in practice, the materials used, as well as their dimensions and components, may be any, depending on the technical requirements.

The invention claimed is:

1. An optic for a LED chip (97) of the COB type, said optic comprises a second element (50) realized with an optical transparent material and having a first proximal end (51) and a second distal end (53), a second external exit surface (58) which is positioned in proximity of said second distal end (53), a first external lateral total internal reflection surface (59) which is positioned between said first proximal end (51) and said second distal end (53) and which is able to redirect and re-distribute a luminous flux produced by said LED chip (97) towards said second external exit surface (58), further said second element (50) comprises a blind internal cavity (52) realized in proximity of said first proximal end (51), which extends internally to said second element (50) substantially along a longitudinal direction (90) towards said second external exit surface (58) for housing said LED chip (97), characterized in that said optic comprises a first element (30) substantially disc shaped, having a central hole (32), which extends externally with respect to said second element (50) in an orthogonal direction with respect to said longitudinal direction (90), and in addition said first element (30) and said second element (50) are formed as a single unitary whole, furthermore said first element (30) is compressible independently with respect to said second element (50) for making said LED chip (97) waterproof and also an electronic board (95) by avoiding at the same time an undesirable modification in the optical properties of said second element (50) and by avoiding at the same time the need of a gasket.

2. Optic according to claim 1, characterized in that said second element (50) is able to surround and completely wrap said LED chip (97), said first element (30), and an outer peripheral portion (35) thereof, being connectable to a housing (12) of a LED lighting device (10) through fastening means so as to create high impermeability and water resistance by reducing the number of components and by avoiding the need of an external glass protection.

3. Optic according to claim 1, characterized in that said first element (30) extends externally with respect to said first proximal end (51) or to said second distal end (53) of said second element (50) in an orthogonal direction with respect to said longitudinal direction (90), and said first element (30) extends externally with respect to said first proximal end (51) in an orthogonal direction with respect to said longitudinal direction (90).

4. Optic according to claim 1, characterized in that said first element (30) and said second element (50) are realized in just one single piece through injection moulding, with an optic grade transparent silicone elastomer for making a LED lighting device (10) waterproof and having a high degree of protection to water, by reducing the number of components and by avoiding the need of an external glass protection.

5. Optic according to claim 4, characterized in that said optic grade transparent silicone elastomer is selected among a methyl silicone, a vinyl-methyl silicone, a phenyl-methyl vinyl silicone and a fluorine-vinyl-methyl silicone and/or their blends and/or their derivatives.

6. Optic according to claim 4, characterized in that said optic grade transparent silicone elastomer has a hardness less than 100 shore.

7. Optic according to claim 1, characterized in that said second element (50) is axially symmetrical with respect to said longitudinal axis (90), and also said first total internal reflection external lateral surface (59) is axially symmetrical with respect to said longitudinal axis (90).

8. Optic according to claim 1, characterized in that said second element (50) has a substantially semi-ovoid form or "free-form" for making different optics.

9. Optic according to claim 1, characterized in that said second element (50) comprises at least two half toroidal or ovoid portions, substantially mutually orthogonal or aligned, which are mutually interpenetrated in one single piece together with said first element (30) for making different optical geometries symmetrical with respect to a direction and asymmetrical with respect to another orthogonal.

10. Optic according to claim 1, characterized in that said first element (30) comprises at least one reference portion (37) realized on an external perimeter and, at least two reference portions (37) realized on an external peripheral portion (35) of said first element (30) for facilitating positioning and for reducing the overall dimensions in the case of coupling of two LED chips (97) with corresponding optics.

11. Optical assembly comprising at least one optic according to claim 1, and further comprising at least a fastener crown (20) comprising a central through hole (23) which allows insertion of said second element (50) through the fastener crown (20), and furthermore comprising a housing (22) for compressing said first element (30) within a housing (12) of a lighting device (10) for making the lighting device (10) waterproof without having to secure said LED chip (97) to said housing (12) and avoiding the need of a gasket or of an additional external glass.

12. Optical assembly according to claim 11, characterized in that said annular housing (22) is coaxial with said central through hole (23) and oriented according to said longitudinal direction (90), and, in addition, said annular housing (22) comprises an annular base surface (25) for exerting a compression on said first element (30) for making waterproof said LED chip (97) and said LED lighting device (10), furthermore said fastener crown (20) comprises a plurality of fastening holes (27) which are more external with respect to said first element (30) of said optic for not piercing said first element (30).

13. Optical assembly comprising a plurality of optics according to claim 11, characterized in that said first element (30) is identical for each optic of said plurality of optics and wherein each second element (50) comprises a different first total internal reflection external lateral surface (59) and/or a different blind internal cavity (52) and/or a different second external exit surface (58) for making a LED lighting device (10) having a plurality of optics waterproof and interchangeable for illuminating large areas and/or road lighting and/or underwater applications by reducing the number of components and by avoiding the need of a gasket or of an additional glass.

14. LED lighting device (10) comprising an optical assembly according to claim 11, and comprising at least one LED chip (97) mounted on an electronic board (95), further said LED lighting device (10) comprises a housing (12) for said at least one optic, for said first element (30) of said optic, in which in turn is housed said at least one LED chip (97).

15. LED lighting device (10) according to claim 14, characterized in that said first element (30) comprises an upper base surface (33) and a lower base surface (31) which is insertable within said housing (12) for surrounding and wrapping up said LED chip (97) and said electronic board (95), said upper base surface (33) of said first element (30) at least in proximity of said outer peripheral portion (35) is coupled with a housing (22) of said fastener crown (20) which is fixable to a body (11) of said LED lighting device (10) in proximity of said housing (12) for compressing said first element (30) within said housing (12) for making waterproof said LED lighting device (10) in a simple and effective way without the need of a gasket or of an additional external glass.

* * * * *